US005339571A

United States Patent [19]

Timmons et al.

[11] Patent Number: 5,339,571

[45] Date of Patent: Aug. 23, 1994

[54] TOOL ELEMENT SUBASSEMBLY

[75] Inventors: Russell M. Timmons, Lutherville; Vladimir S. Karnicki, Baltimore, both of Md.

[73] Assignee: Black & Decker Inc., Newark, Del.

[21] Appl. No.: 144,689

[22] Filed: Oct. 29, 1993

Related U.S. Application Data

[63] Continuation of Ser. No. 978,127, Nov. 18, 1992, Pat. No. 5,287,659, which is a continuation-in-part of Ser. No. 832,147, Feb. 19, 1992, Pat. No. 5,207,028, which is a continuation-in-part of Ser. No. 702,274, May 19, 1991, abandoned.

[51] Int. Cl.[5] ..... B24B 45/00; B24D 13/20

[52] U.S. Cl. ..... 51/168; 51/378; 15/230.18

[58] Field of Search ..... 51/168, 376, 377, 378, 51/379, 170 T, 358, 389; 15/230.18, 230.19

[56] References Cited

U.S. PATENT DOCUMENTS

| | | |
|---|---|---|
| 2,926,469 | 3/1960 | Kubsh . |
| 2,997,819 | 8/1961 | Schacht . |
| 3,041,797 | 7/1962 | Moffly . |
| 3,136,100 | 6/1964 | Robertson, Jr. . |
| 3,250,045 | 5/1966 | Caserta . |
| 3,362,114 | 1/1968 | Hurst . |
| 3,500,592 | 3/1970 | Harrist . |
| 3,528,203 | 9/1970 | Franklin et al. . |
| 3,596,415 | 8/1971 | Donahue, Jr. . |
| 3,667,169 | 6/1972 | Mackay, Jr. . |
| 3,747,286 | 7/1973 | Haigh . |
| 3,844,072 | 10/1974 | Haigh et al. . |
| 3,879,178 | 4/1975 | Bosma . |
| 3,990,124 | 11/1976 | Mackay, Jr. et al. . |
| 4,015,371 | 4/1977 | Grayston . |
| 4,694,615 | 9/1987 | Mackay, Jr. . |
| 4,754,577 | 7/1988 | Mackay, Jr. . |
| 4,754,578 | 7/1988 | Mackay, Jr. . |

*Primary Examiner*—Roscoe V. Parker
*Attorney, Agent, or Firm*—Harness, Dickey & Pierce

[57] ABSTRACT

A tool element subassembly, such as an abrasive disc subassembly, for mounting to the spindle of a grinder. The subassembly includes an abrasive disc, a collar nut and, optionally, a backing flange. The central bore in the abrasive disc as well as the hub portion of the collar nut which fits into the bore are both hexagonally shaped to provide a positive drive connection therebetween. The collar nut is either press fit onto the disc or, alternatively, placed directly into the mold for the disc so that the formed abrasive disc is molded directly to the hub portion of the collar nut. In certain embodiments the collar nut includes an integrally formed, enlarged head portion that is adapted to engage the bottom surface of the abrasive disc and is configured to receive a wrench for tightening the subassembly onto, or loosening the subassembly for removal from, the spindle. In other alternative embodiments the collar nut includes an integral enlarged circular flange that is adapted to engage the top surface of the abrasive disc and an annular lip portion that initially protrudes from the bottom of the collar nut and is adapted to be deformed so as to engage the bottom surface of the abrasive disc and tightly secure the abrasive disc between the enlarged flange portion and deformed lip portion of the collar nut. The collar nut in these embodiments also includes an upper portion above the flange that is configured for receiving a wrench. Additional alternative embodiments are disclosed.

10 Claims, 5 Drawing Sheets

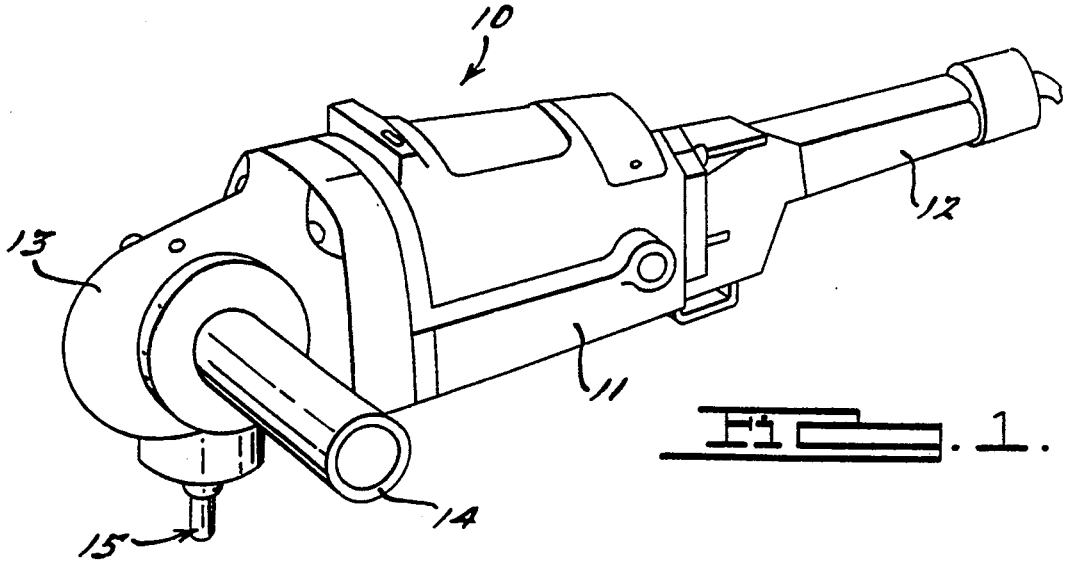
FIG. 1.
FIG. 2.
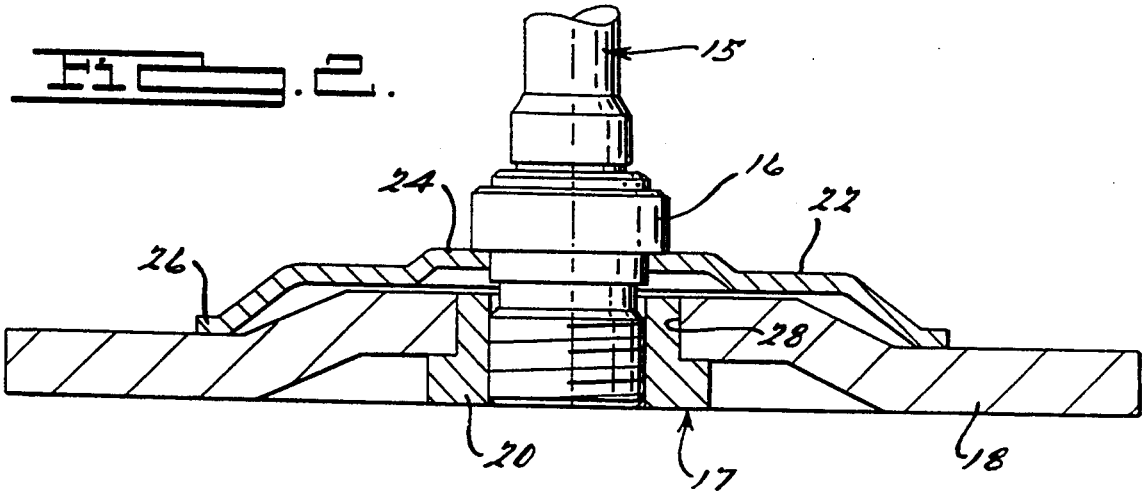
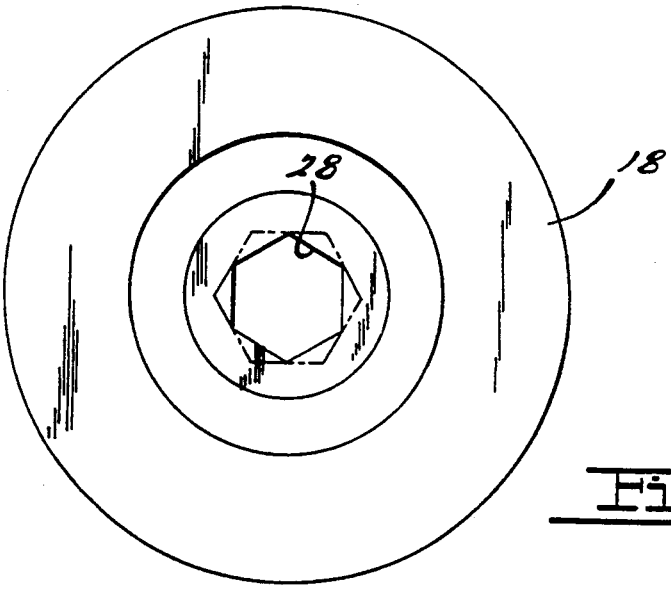
FIG. 3.

TOOL ELEMENT SUBASSEMBLY

RELATED APPLICATION

This is a continuation of U.S. Pat. application Ser. No. 07/978,127, filed Nov. 18, 1992, now U.S. Pat. No. 5,287,639, which is a continuation-in-part of Ser. No. 07/832,147, filed Feb. 6, 1992, now U.S. Pat. No. 5,207,028, which is a continuation-in-part of Ser. No. 07/702,274, filed May 17, 1991, now abandoned.

BACKGROUND AND SUMMARY OF THE INVENTION

The present invention relates to an improved apparatus for coupling a tool element, such as a grinding wheel, to the output spindle of a power tool, such as a portable grinder. Additionally, the present invention relates to an improved method of manufacturing a tool element, such as a grinding wheel.

The grinding wheel used on portable grinders generally consists of an abrasive disc having a centrally located bore for receiving an internally threaded collar nut. The collar nut has a hub portion that fits into the bore in the grinding wheel so that the enlarged hex-shaped head portion of the collar nut abuts the underside of the grinding wheel. The collar nut is adapted to be mounted to the externally threaded spindle of the grinder. Typically, a support flange is positioned on the spindle between the grinding wheel and an annular shoulder formed on the spindle to provide backing support for the grinding wheel. The support flange is typically comprised of a metal stamping that is configured to engage the backside of the abrasive disc around its outer radial end. The direction of rotation of the spindle when the grinder is energized is such that the collar nut will self-thread onto the spindle until a tight frictional engagement is provided between the support flange and the grinding wheel. The grinding wheel can then be further tightened onto, or subsequently removed from, the spindle by applying a wrench to the collar nut.

With conventional abrasive disc subassemblies the central bore in the abrasive disc through which the spindle extends is circular in shape. Similarly, the hub portion of the collar nut that fits into the bore of the disc is also circular in cross-section. The collar nut in such conventional assemblies is not permanently affixed to the abrasive disc, but rather is intended to be reused when a worn disc is replaced. In addition to the possibility of losing or misplacing the collar nut, this type of assembly is further disadvantageous from the standpoint that replacement abrasive discs must have properly sized bores, which are not uniform for all brands and models. Moreover, the application of driving torque from the spindle to the abrasive disc is solely through the frictional interfaces between the abrasive disc and the spindle directly or between the abrasive disc and the supporting flange and the supporting flange and the spindle. Consequently, under load the abrasive disc subassembly may slip at either of these frictional interfaces. To combat slippage, abrasive disc subassemblies are frequently tightened onto the spindle to such a degree that subsequent removal becomes difficult.

To alleviate these problems, various "hubbed"-type abrasive disc subassemblies have been proposed, such as that shown in U.S. Pat. No. 4,494,615 to MacKay, Jr. Hubbed-type abrasive disc subassemblies include a backing flange that is permanently affixed to the backside of the abrasive disc by the hub portion of the collar nut which thus becomes an integral part of the subassembly. The entire subassembly is thus intended to be discarded when the disc is worn. Hubbed-type grinding wheels are generally intended to be used in combination with specially designed support flanges adapted for engaging driving surfaces on the backing flange affixed to the disc.

With each of the known forms of grinding wheel subassemblies, driving torque is transferred from the output spindle of the grinder to the grinding wheel via a frictional coupling, either between the output spindle and the grinding wheel directly, or through an intermediary support flange which either frictionally engages the backside of the grinding wheel or a backing flange permanently affixed thereto. Frictional couplings of the above-described type without support flanges are prone to slippage, or in the alternative, must be tightened to such a degree as to subsequently make it difficult to remove a worn wheel. While the hubbed-type grinding wheels are much less susceptible to slippage problems, they are substantially more expensive than conventional non-hubbed grinding wheels and consequently are not as widely used.

Accordingly, there is need for an improved grinding wheel subassembly that provides a positive means of coupling the grinding wheel to the spindle of the grinder without the expense of the hubbed-type wheel subassemblies. In addition, it is desirable to provide such an improved grinding wheel subassembly that can be readily manufactured as a hubbed or a non-hubbed grinding wheel and can be used with or without a support flange.

Furthermore, it is desirable to provide a grinding wheel subassembly that is compatible with both United States and European safety standards.

BRIEF DESCRIPTION OF THE DRAWINGS

Additional objects and advantages of the present invention will become apparent from a reading of the following detailed description of the preferred embodiments which make reference to the drawings in which:

FIG. 1 is a perspective view of a typical power tool to which the teachings of the present invention may be applied;

FIG. 2 is an elevational, sectional detailed view of the right-angle spindle of the tool shown in FIG. 1, illustrating a first embodiment of a tool subassembly according to the present invention;

FIG. 3 is a plan view of an abrasive disc according to the present invention;

DETAILED DESCRIPTION OF THE PREFERRED EMBODIMENTS

Figure 4:
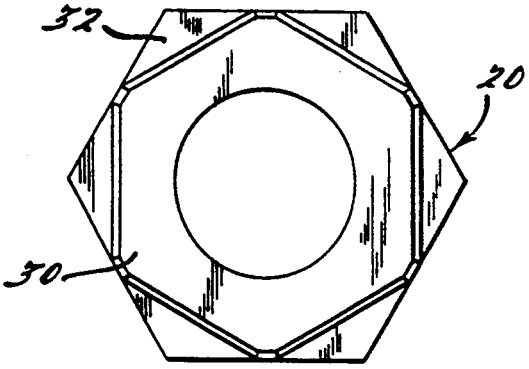
FIG. 4 is a plan view of a collar nut according to the present invention.

With reference to FIG. 1, there is illustrated a portable electric grinder 10 with which the teachings of the present invention may be applied. It will be appreciated by those skilled in the art, however, that the grinder 10 is only exemplary of a wide variety of power tools to which the invention may be applied. With this in mind, the grinder 10 generally comprises a motor housing 11, a switch handle 12, a gear case 13, an auxiliary handle 14, and a right-angle spindle 15 for mounting a grinding wheel subassembly or other tool element subassembly. The guard for the grinder has been removed in FIG. 1 for the sake of clarity. With further reference to FIG. 2, the spindle 15 is externally threaded and has an annular shoulder 16 formed thereon. A tool element subassembly, or abrasive disc subassembly 17, is threadably mounted on the spindle 15. The abrasive disc subassembly includes a depressed center abrasive disc 18 that is coupled to an internally threaded collar nut 20. It should be noted at this point that while the preferred embodiments are described and illustrated in combination with depressed center abrasive discs, the present invention is equally applicable to flat "type 1" abrasive discs as well.

The abrasive disc subassembly 17 is supported in FIG. 2 by a supporting flange 22 that is positioned on the spindle 15 of the grinder so that the central portion 24 of the flange abuts the annular shoulder 16 of the spindle. In addition, the support flange 22 is typically configured so that the outer distal end portion 26 supports the backside of the abrasive disc 18 radially outward of the depressed center portion of the abrasive disc 18 as shown. Due to the direction of rotation of the spindle 15 relative to the threads on the spindle, when the grinder is energized the collar nut 20 of the subassembly 17 will self-thread onto the spindle until the backside of the abrasive disc 18 bears against the distal end portion 26 of supporting flange 22. Support flange 22 thus also provides a frictional drive coupling between the spindle 15 of the grinder and the abrasive disc 18.

Figure 5:
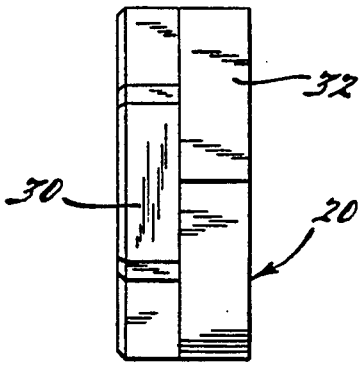
FIG. 5 is a side view of the collar nut shown in FIG. 4.

With additional reference to FIGS. 3-5, the abrasive disc 18 and collar nut 20 components of the tool element subassembly 17 according to the present invention are shown. The abrasive disc 18 in the preferred embodiment illustrated in FIG. 3 is provided with a hexagonally shaped central bore 28, rather than the conventional circular bore. In addition, the collar nut 20 is formed with a corresponding hexagonally shaped hub portion 30 that is adapted to be press fit into the bore 28 in the abrasive disc 18. In particular, the collar nut 20 in the preferred embodiment shown in FIGS. 4 and 5 includes a first hexagonally shaped hub portion 30 which, as noted, is precisely sized to tightly fit within the correspondingly configured hexagonal central bore 28 in the abrasive disc 18. The enlarged hexagonally shaped head portion 32 of the collar nut 20 is integrally formed with the hub portion 30 in an angularly offset manner relative to the hexagonal hub portion 30 to maximize the contact area between head portion 32 and the underside of the abrasive disc 18. In particular, as best shown in FIG. 4, the hex-head portion 32 is angularly offset thirty degrees relative to the smaller hex-hub portion 30 such that the apexes of the hex-hub 30 are radially aligned with the midpoints of the flats of the hex-head portion 32 and vice versa. This particular relationship between the two integral hex portions of the collar nut 20, however, is not critical to the function of the present invention.

Accordingly, it will be appreciated that when the abrasive disc subassembly 17 according to the present invention is threaded onto the spindle 15 of the grinder, a positive drive coupling is created between the spindle 15 and the abrasive disc 18 due to the hexagonal-shaped interface between the hub portion 30 of the collar nut 20 and the abrasive disc 18. In other words, because the abrasive disc 18 in the subassembly 17 of the present invention is precluded from rotating relative to the collar nut 20, it no longer becomes necessary to rely upon the frictional interface between the spindle 15 and the abrasive disc, either directly or via a backing flange, to transmit rotational torque from the spindle 15 to the abrasive disc. Moreover, due to the fact that abrasive discs 18 are typically formed in a press via a molding process, it does not add to the cost of manufacture to form a hexagonal-shaped bore in the abrasive disc rather than a circular bore.

Obviously, as will be appreciated by those skilled in the art, it is not critical to the teachings of the present invention that the bore 28 in the abrasive disc 18 and the hub portion 30 of the collar nut 20 be hexagonally shaped. Rather, it is important that the shape be substantially noncircular so as to preclude relative rotation between the abrasive disc 18 and the collar nut 20. Consequently, alternative shapes could include square, spline, pentagonal, etc. In addition, it will further be appreciated that other means for affixing the collar nut 20 to the abrasive disc 18 can be used. Specifically, in addition to the press fitting method previously described, the hub portion 30 of the collar nut 20 may be deformed after insertion into the bore 28 in the abrasive disc 18, or a portion of the hub material deflected, to create a mechanical locking engagement between the collar nut and the abrasive disc. Additionally, an adhesive may also be used if desired.

As previously noted, a preferred method of manufacturing the abrasive disc subassembly 17 according to the present invention contemplates press fitting the hub portion 30 of the collar nut 20 into the bore 28 of the abrasive disc. In this manner the collar nut 20 can be tightly secured to the abrasive disc 18 without materially altering the production process for the abrasive disc. Alternatively, the collar nut 20 can be inserted directly into the abrasive disc mold during the molding process so that the abrasive disc 18 is formed directly to the hub portion 30 of the collar nut 20.

Figure 6:
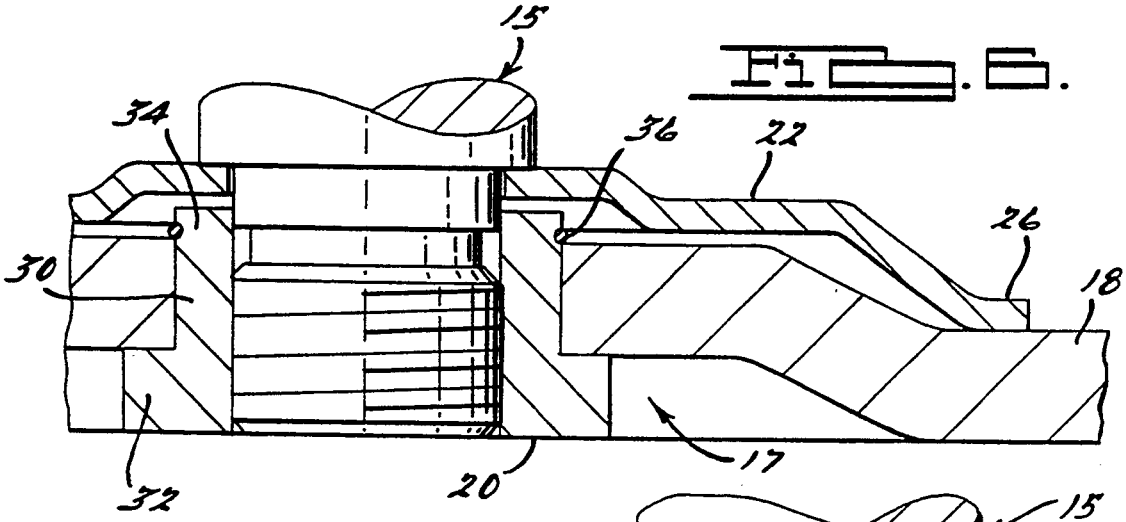
FIG. 6 is an elevational, sectional detailed view of the right-angle spindle of the tool shown in FIG. 1, illustrating a second embodiment of a tool subassembly according to the present invention.

Turning to FIG. 6, a further alternative construction of the abrasive disc subassembly 17 according to the present invention is shown. In this embodiment, the hub portion 30 of the collar nut 20 is modified so as to extend above the top surface of the abrasive disc 18 when installed. An annular recess is formed in this extended portion 34 for receiving a snap ring 36 as shown to prevent removal of the collar nut 20 from the abrasive disc 18. In this embodiment, it is not as critical that the hub portion 30 of the collar nut 20 be sized precisely to conform to the hex-bore 28 in the abrasive disc 18.

Figure 7:
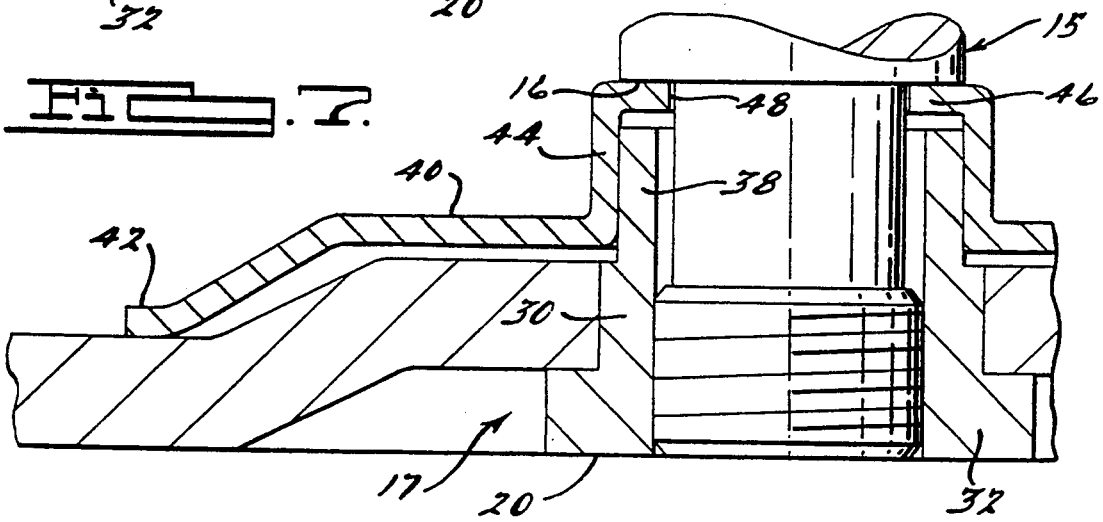
FIG. 7 is an elevational, sectional detailed view of the right-angle spindle of the tool shown in FIG. 1, illustrating a third embodiment of a tool subassembly according to the present invention.

Referring now to FIG. 7, a further alternative embodiment of the present invention is shown. In this embodiment the subassembly 17 is modified to include a permanently affixed backing flange to the backside of the abrasive disc 18. In particular, it will be noted that the collar nut 20 in this embodiment is formed with an integral tubular extension 38 which extends from the hub portion 30 of the collar nut 20. The backing flange 40 is comprised of a metal stamping that includes a distal end portion 42 that is adapted to contact the backside of the abrasive disc 18 radially outward from the depressed center portion so that the backing flange 40 is spaced away from the abrasive disc 18 radially inward of the distal end portion 42. The central part of backing flange 40 forms an upstanding neck portion 44 that defines a cylindrical recess for receiving the tubular extension 38 of the collar nut 20. The neck portion 44 is appropriately sized so that it can be press fit onto the tubular extension 38 of the collar nut 20, thereby fixedly joining the two components. The upper end of the neck portion 44 is preferably formed with an inwardly extending shoulder 46 that defines a circular opening 48 appropriately sized to receive the end portion of the spindle 15 below the annular shoulder 16. In this manner, when subassembly 17 is threaded onto the spindle 15, the shoulder portion 46 of the backing flange 40 bears against the annular shoulder 16 on the spindle 15. In addition, since the collar nut 20 in this embodiment is tightly secured to the backing flange 40, it is not necessary for the abrasive disc 18 to also be press fit onto the hub portion 30 of the collar nut 20 in order to secure the collar nut to the subassembly 17.

Figure 8:
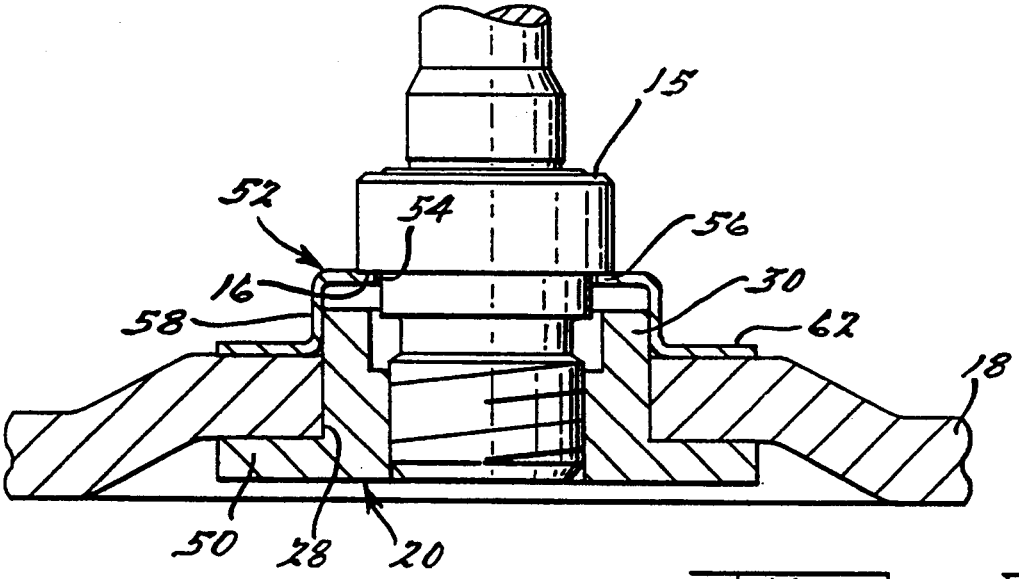
FIG. 8 is an elevational, sectional detailed view of the right angle spindle of the tool shown in FIG. 1, illustrating a fourth embodiment of a tool assembly according to the present invention.
Figure 9:
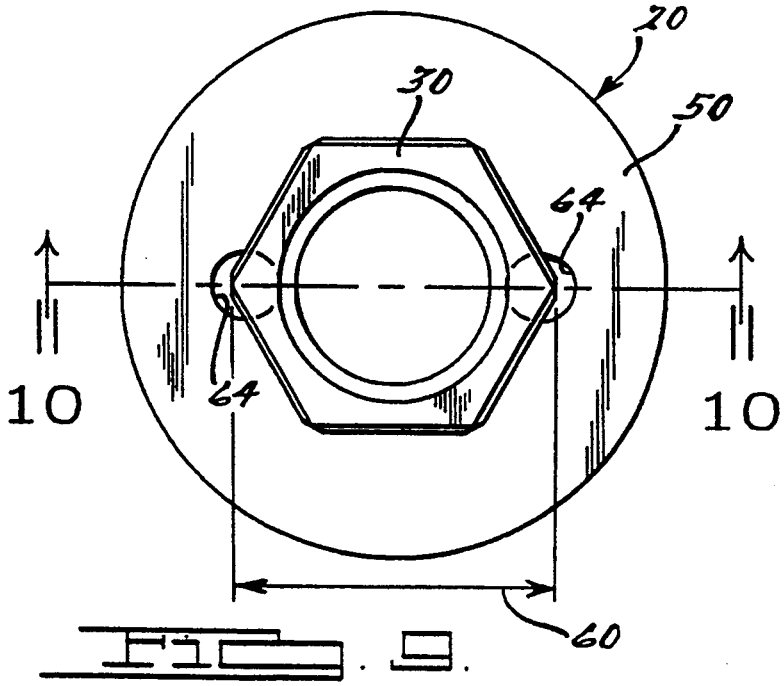
FIG. 9 is a plan view of an alternative embodiment of the collar nut of the present invention.
Figure 10:
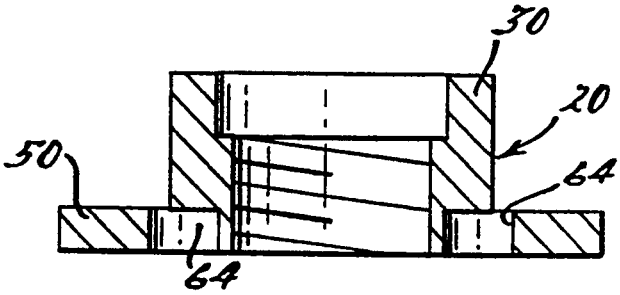
FIG. 10 is a sectional view of the collar nut shown in FIG. 9 taken along line 10—10.

Referring to FIGS. 8–10, a fourth embodiment of the present invention is shown. In this embodiment the collar nut 20 comprises a hexagonal-shaped hub portion 30 as in the previous embodiments and an integrally formed enlarged round head portion 50 that is adapted to seat against the underside of the depressed-center portion of the abrasive disc 18 when the hub portion 30 of the collar nut is inserted through the correspondingly configured hexagonal-shaped hole 28 in the abrasive disc 18. The axial height of the hub portion 30 of the collar nut 20 is greater than the thickness of the abrasive disc 18 so that the hub portion 30 extends above the top surface of the abrasive disc.

The collar nut 20 is secured to the abrasive disc 18 in this embodiment by a retainer flange member 52. The retainer flange member 52 comprises a generally "hat"-shaped member having an appropriately sized bore 54 formed through the top for receiving the end portion of the spindle 15 below the annular shoulder 16. The resulting inwardly directed upper flange 56 of member 52 is adapted to contact and bear against the annular shoulder 16 of the spindle 15. The inside diameter of the cylindrical portion 58 of the retainer flange member 52 is dimensioned to tightly fit over the protruding upper end of the hub portion 30 of the collar nut 20. In other words, the apex-to-apex diameter 60 (FIG. 9) of the hexagonal-shaped hub portion 30 is dimensioned to be slightly larger than the inside diameter of the cylindrical portion 58 of the retainer flange member 52. The retainer flange member 52 is thus adapted to be press-fit onto the hex-shaped hub portion 30 of the collar nut 20 until the outwardly extending lower flange portion 62 of the retainer flange member 52 contacts the top of the abrasive disc 18, thereby capturing the abrasive disc 18 between the flange member 52 and the enlarged head portion 50 of the collar nut 20. The resulting frictional engagement between the collar nut 20 and the retainer flange member 52 is such that the assembled components form a unitary assembly. In addition, as with the embodiment described in FIG. 7, it is not necessary for the abrasive disc 18 to also be press fit onto the hub portion 30 of the collar nut 20 in order to secure the collar nut to the assembly.

In addition, it should also be noted that the same collar nut 20 and retainer flange 52 components used with a ¼-inch abrasive disc 18 as shown in FIG. 7 can also be used with the thinner ⅛-inch abrasive discs by adding a ⅛-inch thick annular-shaped spacer element between the retainer flange 52 and the abrasive disc 18. The spacer element preferably has an inside diameter slightly larger than dimension 60, so that it will fit over the hub portion 30, and an outside diameter equal to the lower flange portion 62 of the retainer flange member 52.

The resulting abrasive disc assembly is adapted to be installed onto the spindle 15 of the grinder by threading the collar nut 20 onto the spindle 15 until the upper flange 56 of the retainer flange member 52 contacts the annular shoulder 16 of the spindle 15. A pair of holes 64 are formed in the head portion 50 of the collar nut 20 for receiving a spanner wrench to tighten the collar nut 20 onto the spindle 15, as well as to loosen the collar nut for removal and replacement of the abrasive disc assembly. Alternatively, a raised hexagonal drive may be integrally formed on the bottom of head portion 50 of the collar nut 20 in place of holes 64 for receiving a conventional wrench or drive socket. However, such a modification would also preferably be accompanied by a reduction in the thickness of the head portion 50 so that the raised hex-drive did not extend below the working surface of the abrasive disc 18.

Significantly, it will be noted in this embodiment of the invention that the diameter of the lower flange portion 62 of the retainer flange member 52 that bears against the top surface of the abrasive disc 18 is equal to the diameter of the head portion 50 of the collar nut 20 that bears against the bottom surface of the abrasive disc 18. This configuration, together with the positive hexagonal drive coupling between the collar nut 20 and the abrasive disc 18, renders the assembly compatible with the DIN specifications for the European market. Moreover, since the A.N.S.I. specifications in the United States require the use of a backing flange (as shown in FIGS. 2, 6, and 7) only for abrasive discs 18 greater than five inches in diameter, the alternative embodiment of the present invention shown in FIGS. 8–10, when limited to the smaller-sized 4½" grinding wheels, is universally compatible with both European and United States specifications and is therefore saleable and usable in both markets.

Figure 11:
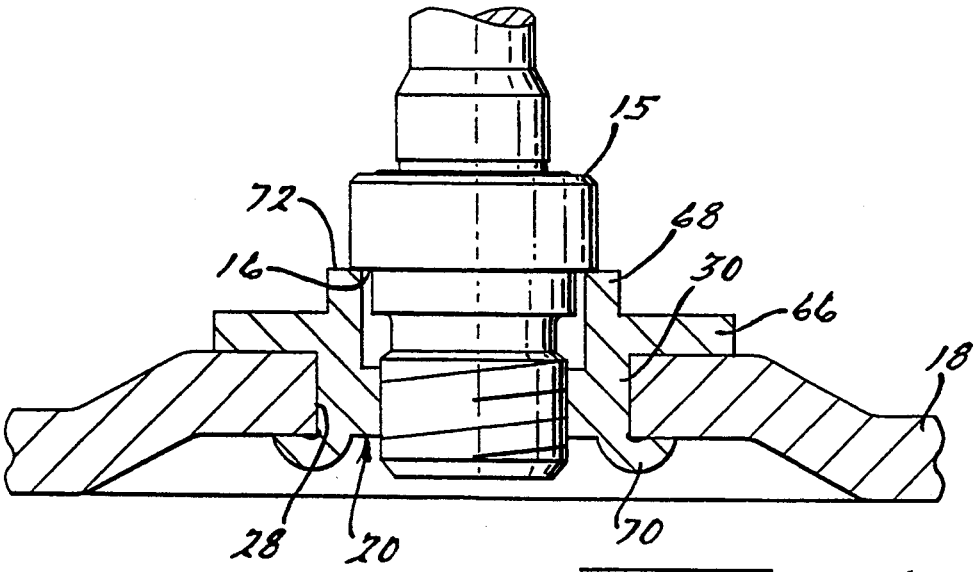
FIG. 11 is an elevational, sectional detailed view of the right angle spindle of the tool shown in FIG. 1 illustrating a fifth embodiment of a tool assembly according to the present invention.
Figure 12:
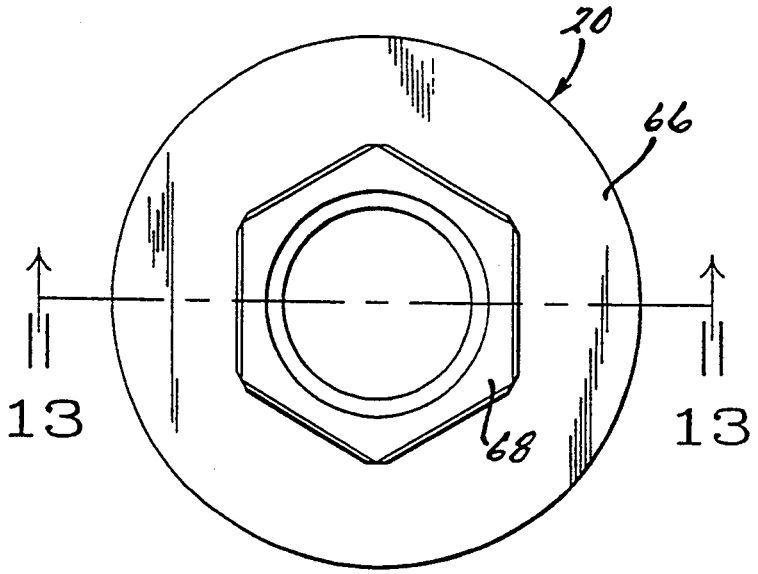
FIG. 12 is a top plan view of the alternative embodiment of the collar nut shown in FIG. 11.
Figure 13:
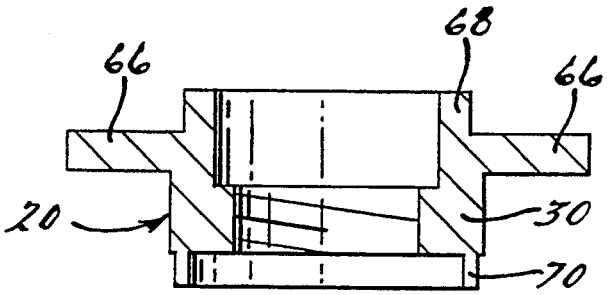
FIG. 13 is a sectional view of the collar nut taken along line 13—13 in FIG. 12.
Figure 14:
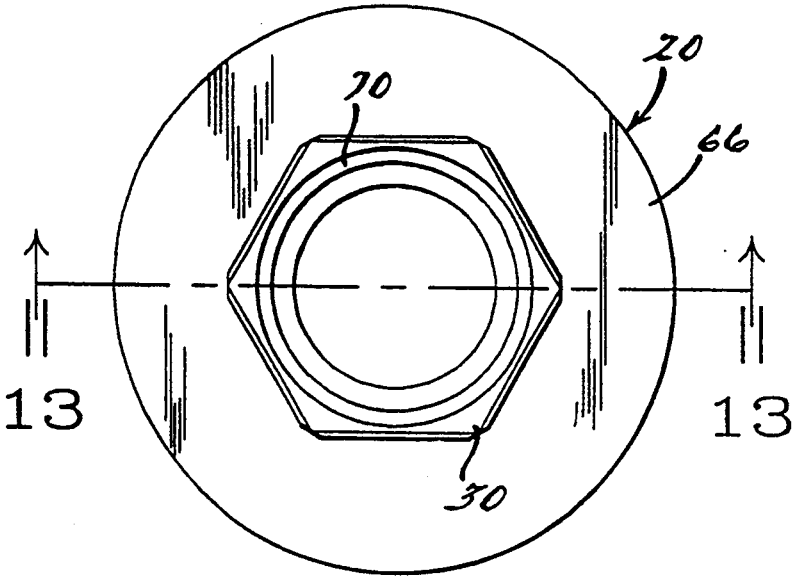
FIG. 14 is a bottom plan view of the alternative embodiment of the collar nut shown in FIG. 11.

Turning now to FIGS. 11–14, a fifth embodiment of the present invention is shown. In this embodiment, the collar nut 20 comprises a hexagonal-shaped hub portion 30 as in the previous embodiments, an enlarged integral circular flange 66, and an upper hexagonal-shaped portion 68 extending axially above the circular flange. As best shown in FIG. 13, the collar nut 20 in its initial form additionally has extending from the bottom of the hub portion 30 an integral annular lip 70 whose outside diameter is approximately equal to the distance between the opposite flats of the hexagonal hub portion 30. The collar nut 20 is assembled to the abrasive disc 18 by inserting the hub portion 30 from above the abrasive disc 18 downwardly into the correspondingly hexagonal-shaped bore 28 in the abrasive disc 18 until the enlarged circular flange 66 abuts the top surface of the abrasive disc 18 and the annular lip portion 70 protrudes from the bottom of the abrasive disc. The annular lip 70 of the collar nut 20 is then "rolled over" in a cold forming operation onto the underside of the abrasive disc as shown in FIG. 11 so as to engage the abrasive disc 18 adjacent the hexagonal bore 28 in the abrasive disc. The abrasive disc 18 is thus tightly secured between the cold formed lip portion 70 and the enlarged circular flange portion 66 of the collar nut 20.

The completed subassembly is then adapted to be threaded onto the spindle 15 of the tool until the top surface 72 of the upper hex portion 68 abuts the shoulder 16 of the spindle 15. The upper hex portion 68 of the collar nut 20 thus serves in this embodiment as a means for receiving an open-ended wrench to assist in tightening the subassembly onto, or loosening the subassembly for removal from, the spindle 15 of the tool. Although the preferred form of this embodiment shows the upper hex portion 68 of the collar nut 20 angularly offset thirty degrees relative to the hex-hub portion 30, this is not critical to the invention.

Figure 15:
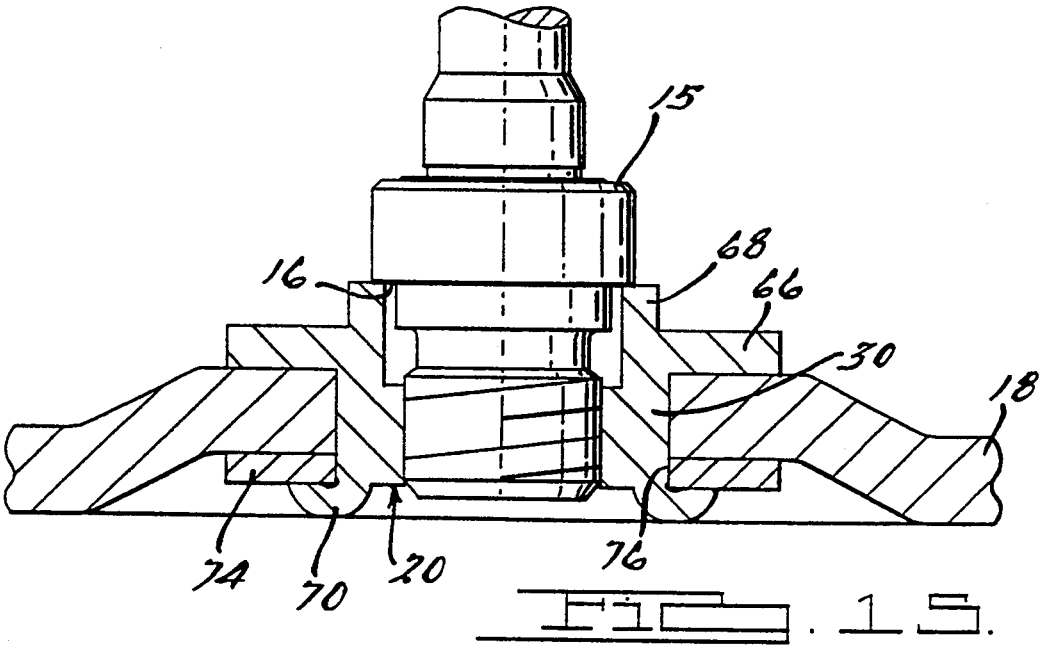
FIG. 15 is an elevational, sectional detailed view of the right angle spindle of the tool shown in FIG. 1 illustrating a sixth embodiment of a tool assembly according to the present invention.

A further variation of the alternative embodiment shown in FIGS. 11–14 is illustrated in FIG. 15. In this embodiment the axial length of the hex-hub portion 30 of the collar nut 20 is extended to accept a metal washer 74 having a hexagonal-shaped central bore 76 and a circular outside diameter equal to the diameter of the enlarged circular flange portion 66 of the collar nut 20. During assembly of the abrasive disc subassembly, the washer 74 is placed onto the hub portion 30 of the collar nut 20 against the underside of the abrasive disc 18. The lip 70 of the collar nut 20 is then rolled over onto the washer 74 to tightly retain the abrasive disc 18 between the enlarged circular flange portion 66 of the collar nut 20 and the washer 74. For the reasons noted above with respect to the embodiment illustrated in FIGS. 8–10, the embodiment shown in FIG. 15 is also compatible with the DIN specifications for the European market.

Thus, it will be appreciated that the present invention discloses a novel tool subassembly that provides a positive drive between the tool subassembly and the arbor of the tool. Moreover, the present invention is readily adapted for use in combination with or without a supporting flange and is suited for convenient manufacture as a "hubbed" or a non-hubbed tool subassembly.

Additional benefits and advantages of the present invention will become apparent to those skilled in the art to which this invention relates from the subsequent description of the preferred embodiments and the appended claims, taken in conjunction with the accompanying drawings.

What is claimed is:

1. An abrasive disc subassembly for a grinder having an externally threaded motor-driven spindle, comprising:

an abrasive disc defining a front working side and a backside and having a depressed center section relative to said front working side and a working section radially outward from said depressed center section, and a centrally located noncircular bore formed through said depressed center section;

a collar nut having a hub portion adapted to fit into said bore in said abrasive disc and configured so as to preclude relative rotation therebetween and an enlarged head portion engaging said front working side of said abrasive disc only in said depressed center section thereof, said collar nut having an internally threaded bore formed therethrough that is adapted for threadably engaging said spindle; and a flange member having an inner radial portion adapted to drivingly engage said spindle and an outer radial portion for supporting and engaging said backside of said abrasive disc only in said depressed center section thereof.

2. The subassembly of claim 1 further including means for securing said flange member to said hub portion of said collar nut.

3. The subassembly of claim 2 wherein said flange member is frictionally secured to said hub portion of said collar nut.

4. The subassembly of claim 2 wherein said enlarged head portion of said collar nut and said outer radial portion of said flange member are both substantially circular and of substantially equal diameter.

5. The subassembly of claim 1 wherein said flange member is integrally formed with said collar nut.

6. An abrasive disc subassembly for a grinder having an externally threaded motor-driven spindle, comprising:

an abrasive disc defining a front working side and a backside and having a depressed center section relative to said front working side and a working section radially outward from said depressed center section, and a centrally located noncircular bore formed through said depressed center section; and a collar nut having a hub portion adapted to fit into said bore in said abrasive disc and configured so as to preclude relative rotation therebetween, an integrally formed flange portion for supporting and engaging said backside of said abrasive disc only in said depressed center section thereof, an inner radial portion for drivingly engaging said spindle, and an enlarged head portion for engaging said front working side of said abrasive disc only in said depressed center section thereof;

said collar nut further having an internally threaded bore formed therethrough that is adapted for threadably engaging said spindle to couple said tool element subassembly to said spindle.

7. The subassemlby of claim 6 further including an annular-shaped washer positioned to engage said front working side of said abrasive disc only in said depressed center section thereof and wherein said enlarged head portion of said collar nut engages and secures said washer against said abrasive disc.

8. The subassembly of claim 7 wherein said flange portion is substantially circular and has a diameter substantially equal to the diameter of said washer.

9. The subassembly of claim 8 wherein said washer has a central hexagonally shaped bore of substantially identical size to said hub portion of said collar nut, said washer being adapted to be positioned on said hub portion of said collar nut.

10. An abrasive disc subassembly for a grinder having an externally threaded motor-driven spindle, comprising:

an abrasive disc defining a front working side and a backside and having a depressed center section relative to said front working side and a working section radially outward from said depressed center section, and a centrally located noncircular bore formed through said depressed center section;

a collar nut having a hub portion adapted to fit into said bore in said abrasive disc and configured so as to preclude relative rotation therebetween, said collar nut having an internally threaded bore formed therethrough that is adapted for threadably engaging said spindle;

a flange member for supporting and engaging said backside of said abrasive disc only in said depressed center section thereof;

means for joining said flange member to said collar nut;

means for securing said collar nut to said abrasive disc; and means for drivingly coupling said subassembly to said spindle.

* * * * *

UNITED STATES PATENT AND TRADEMARK OFFICE

CERTIFICATE OF CORRECTION

PATENT NO. : 5,339,571

DATED : August 23, 1994

INVENTOR(S) : Russell M. Timmons et al.

It is certified that error appears in the above-identified patent and that said Letters Patent is hereby corrected as shown below:

ON THE TITLE PAGE, under "Related U.S. Application Data", "February 19, 1992" should be –February 6, 1992–.

ON THE TITLE PAGE, under "Related U.S. Application Data", "May 19, 1991" should be –May 17, 1991–.

Signed and Sealed this

Thirteenth Day of December, 1994

*Attest:*

Bruce Lehman

BRUCE LEHMAN

*Attesting Officer*

*Commissioner of Patents and Trademarks*